United States Patent [19]

Streim et al.

[11] 4,026,417

[45] May 31, 1977

[54] DISPLAY STAND

[75] Inventors: Edward H. Streim, Manhasset, N.Y.; Thomas Strasser, Fort Lee, N.J.

[73] Assignee: Monet Jewelers, Inc., New York, N.Y.

[22] Filed: June 26, 1975

[21] Appl. No.: 590,753

[52] U.S. Cl. ..... 211/163; 108/94; 211/58; 211/131; 312/135

[51] Int. Cl.[2] ..... A47F 5/02

[58] Field of Search ..... 221/77, 78, 129, 131, 221/70, 144, 163, 113, 119, 189; 108/92, 94, 103, 139; 312/187, 193, 135, 125; 40/124, 124.2, 124.4, 68, 68.4, 324, 10, 16, 16.4, 17, 16.2, 19.5; 248/349, 131, 159, 415; 211/13, 95, 96, 115, 50, 51

[56] References Cited

UNITED STATES PATENTS

| | | | |
|---|---|---|---|
| 716,261 | 12/1902 | Merton | 211/50 |
| 1,732,298 | 10/1929 | Arthur | 211/131 X |
| 2,081,856 | 5/1937 | Frick | 211/144 X |
| 2,726,912 | 12/1955 | Wassell | 211/131 X |

FOREIGN PATENTS OR APPLICATIONS

| | | | |
|---|---|---|---|
| 1,194,133 | 5/1959 | France | 211/163 |
| 20,553 | 7/1904 | United Kingdom | 248/131 |

*Primary Examiner*—Marion Parsons, Jr.
*Assistant Examiner*—Terrell P. Lewis
*Attorney, Agent, or Firm*—G. O. Enockson; L. M. Lillehaugen

[57] ABSTRACT

An anti-theft display stand for holding merchandise which is mounted on small cards. The display stand includes a number of tiered platforms which are rotatably mounted on a vertical shaft, and a number of tiered guard plates which are paired with the platforms so that a plate is superposed over each platform. The guard plates are non-rotatable relative to the shaft and platforms. The cards are mounted on the platforms so that their removal is restricted.

7 Claims, 4 Drawing Figures

112
110
B
10
72
46
100
86
34
44
84
32
42
82
102
30
40
80
28
38
78
102
26
36
76
102
100
98
24
97
16
B

DISPLAY STAND

The present invention relates to display devices for holding merchandise, and more particularly to an anti-theft display stand for holding rectangularly-shaped cards, such cards having jewelry items or the like, secured thereto. Removal of the cards from the stand is restricted in such a way that it can be done only under certain prescribed conditions.

Numerous types of displays are known in the art for holding a variety of items. In the jewelry field for example, displays are effectively used for holding and displaying a multitude of individual jewelry pieces. It is common to mount pairs of earrings on rectangular cards, and position these cards on a display so that they can be conveniently viewed by a purchaser and readily removed from the display for closer observatin and/or purchase.

Such displays should preferably be aesthetically attractive, so as to not detract from the merchandise being displayed, occupy a minimum amount of space since they ofttimes are positioned on a counter for easy view, and hold a large amount of merchandise.

Pilferage or theft of merchandise mounted on a display is a critical problem. Since merchandise of the jewelry type must be conveniently located for a prospective purchaser, it is not uncommon that large amounts of merchandise are stolen if some system is not provided to prevent such acts. Thus, it has been discovered that some means or procedure is desirable to prevent or minimize unauthorized removal of the merchandise for the display.

Accordingly, one object of the present invention is to provide an improved display for holding and exhibiting rectangularly shaped cards.

Another object is to provide an anti-theft display device for holding display cards in such a manner that their removal from the display is restricted or controlled.

A further object is to provide a tiered display stand for holding and displaying card-mounted pieces of jewelry in such a manner that the jewelry can be readily viewed, but their removal from the display stand is restricted.

Other objects and advantages of this invention will become apparent from a consideration of the following specification and accompanying drawings. Before proceeding with a detailed description of the invention however, a brief resume of it will be presented.

In general, the invention comprises a tiered display stand which includes a series of platforms rotatably mounted on a vertically oriented shaft. A plurality of display cards are secured to the platforms in such a manner that their removal therefrom is restricted. A guard plate, non-rotatably mounted on the shaft, cooperates with the platform to restrict the ready removal of the display cards from the platform.

The invention will best be understood by reference to the following drawings, wherein.

Figure 3:
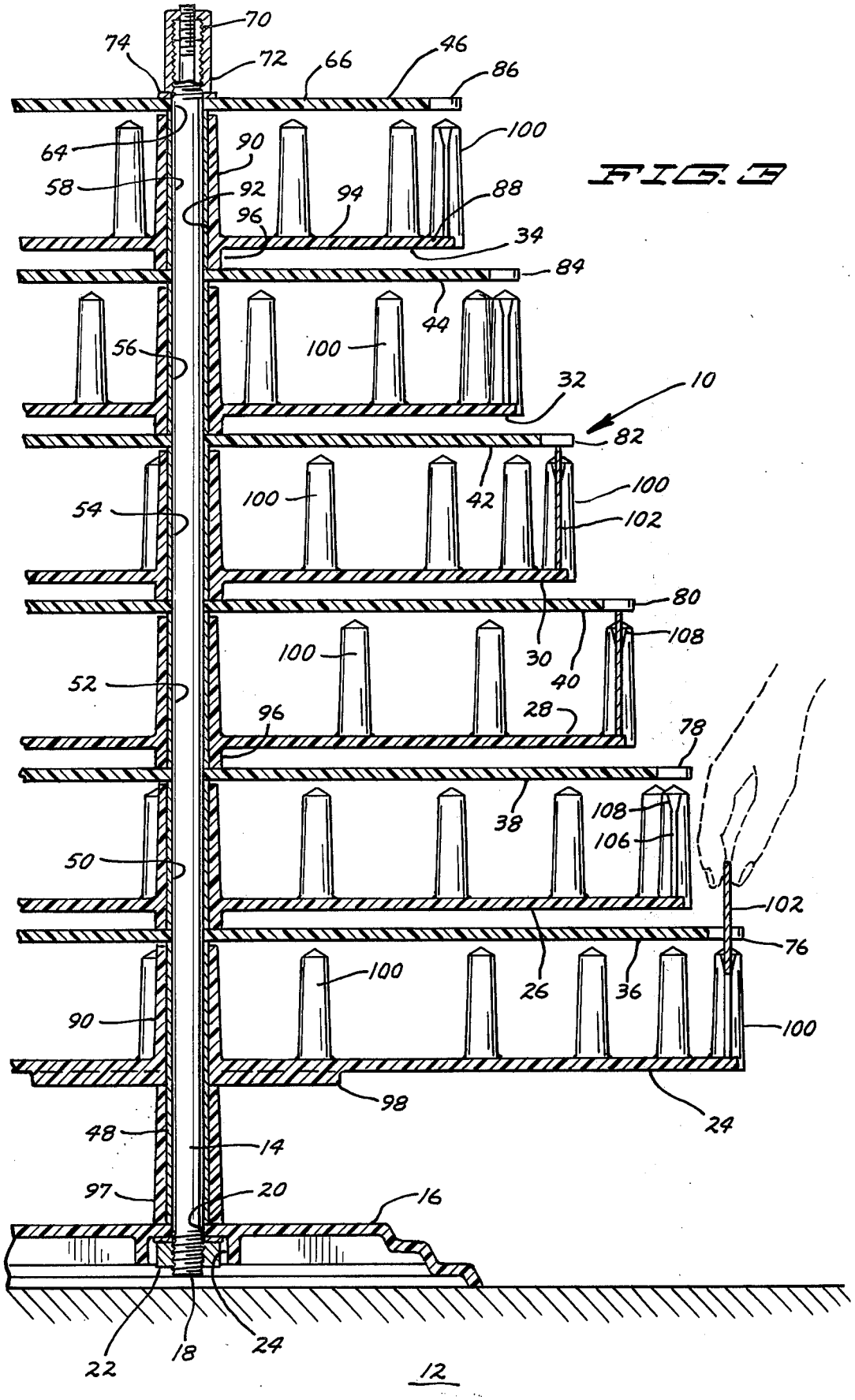
FIG. 3 is a partial sectional view taken along line 3—3 of FIG. 1.

The figures illustrate a tiered display stand designated generally by reference numeral 10 as being positioned on a surface 12, such as a counter top in a store. The display stand is shown as retaining a number of merchandise-holding cards 102. As shown, most clearly in FIG. 3, a vertically oriented shaft 14 is connected to a base member 16 by inserting a threaded end 18 through an aperture 20 in the base. The shaft also has a second threaded end 70. A nut 22 positioned within a cavity 24 on the underside of the base 14, threadedly engages the threaded shaft end 18.

A series of superposed circular platforms or tiers 24, 26, 28, 30, 32 and 34 are rotatably mounted on the shaft 14 and a series of superposed circular guard plates 36, 38, 40, 42, 44 and 46 are non-rotatably mounted on the shaft in close proximity to the platforms. As explained more fully below, the platforms and guard plates are paired together so that they effectively control the removal of merchandise from the display stand. In addition, a number of sleeves or separators 48, 50, 52, 54, 56 and 58 are mounted on the shaft. As depicted, the platforms and guard plates are axially aligned along the shaft 14, and their respective diameters decrease in length in an upward direction, so that the uppermost platform 34 and guard plate 46 have the smallest diameter, whereas the lowermost platform 24 and guard plate 36 have the largest diameter.

The sleeves 48–58 and the guard plates 36–46 are mounted on the shaft 16 so that they are not rotatable about the shaft axis. The sleeves have an inside diameter which is slightly larger than the diameter of the shaft so that they can be readily slipped onto the shaft. It should be noted that the sleeves 50–58 are substantially the same length, whereas the sleeve 48 is substantially longer.

The guard plates are formed so that they will all have the same general shape and configuration; however, as pointed out above, their respective diameters vary in length. For purposes of description, only a single guard plate will be described in detail. As viewed in FIG. 3, the top guard plate 46 includes an outer rim 60, a hub 62 having a bore 64 therein, and a number of spokes 66 which connect the rim to the hub. The size of the bore 64 is only slightly larger than the diameter of the shaft 14 so that the guard plates fit snugly onto the shaft.

Most of the guard plates are positioned on the shaft so that they are interposed between a pair of sleeves. The plate 36 is interposed between the sleeves 48 and 50; the plate 38 is interposed between the sleeves 50 and 52; the plate 40 is interposed between the sleeves 52 and 54; the plate 42 is interposed between the sleeves 54 and 56; the plate 44 is interposed between the sleeves 56 and 58; and the plate 46 rests on the top of the sleeve 58. An internally threaded member 72 is threaded onto the top end 70 of the shaft, and a washer 74 is interposed between the plate 46 and the member 72.

Figure 2:
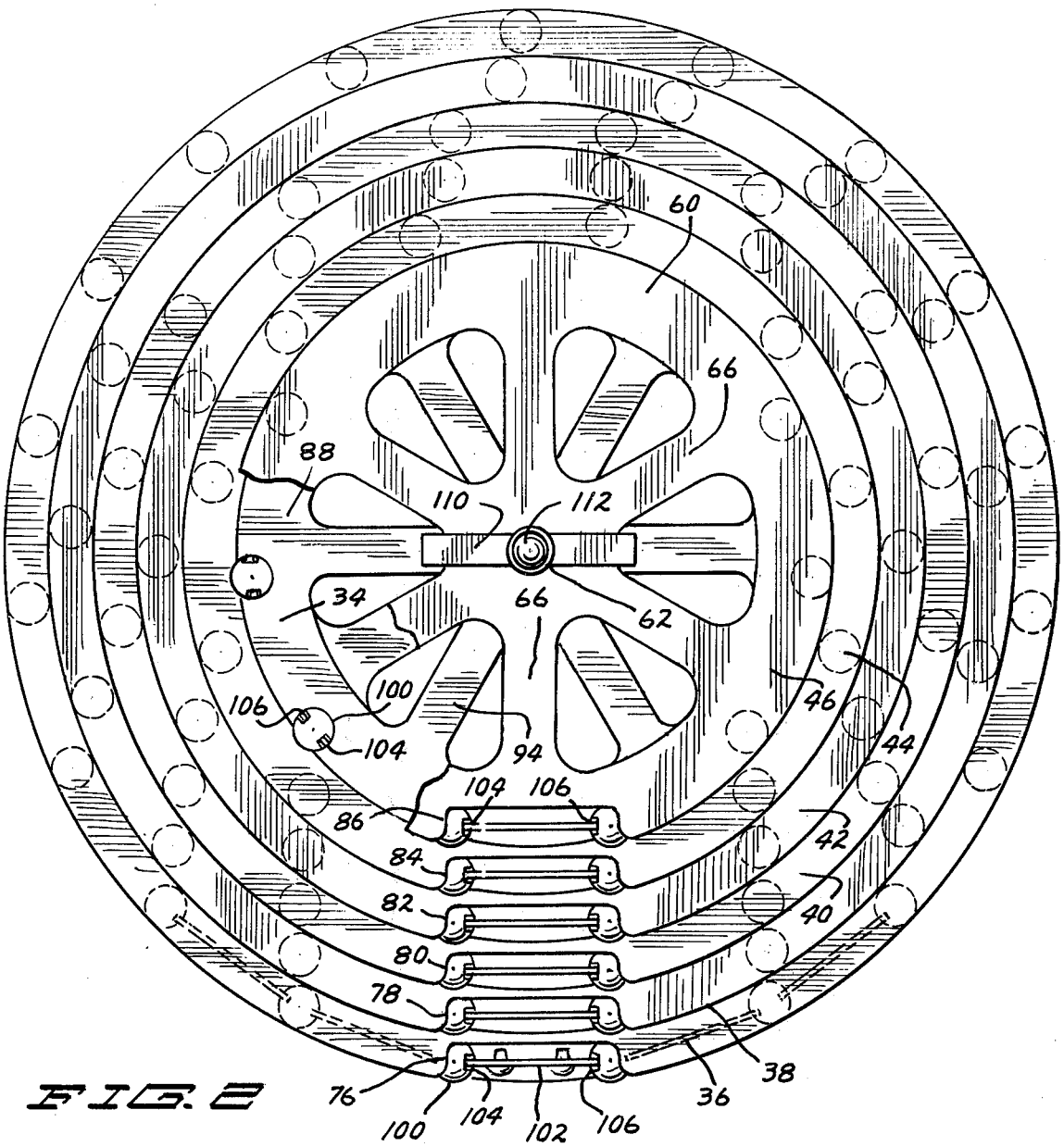
FIG. 2 is a top plan view of the display device.
Figure 4:
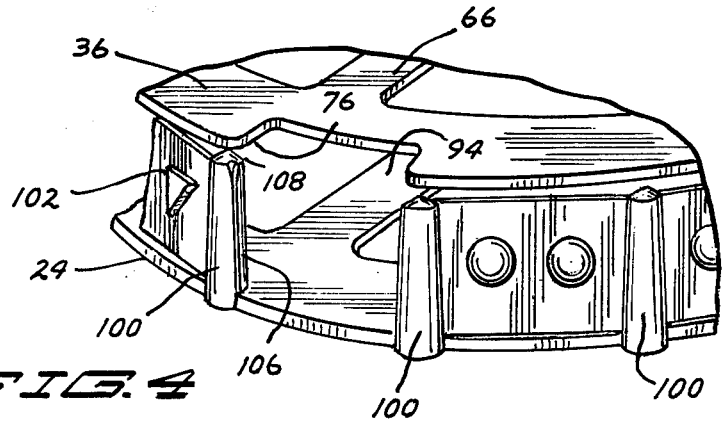
FIG. 4 is a partial perspective view which illustrates display cards which cannot be removed from the display stand.

Each of the guard plates is provided with a somewhat rectangularly-shaped notch or passage along its outer edge or periphery. As seen in FIG. 2, the guard plate 36 has a notch 76, the plate 38 has a notch 78, the plate 40 has a notch 80, the plate 42 has a notch 82, the plate 44 has a notch 84, and the plate 46 has a notch 86. As viewed from the top (in FIG. 2) each of the notches has substantially the same size and shape.

Reference is now made to the specific construction of the platforms or tiers 24–34. In general, all of the platforms have a circular configuration and are formed in substantially the same manner; as a result, only one platform will be described in detail. The platform 34 is formed as having an outer rim 88, a sleeve 90 having a bore 92 therethrough, which forms the hub of the platform, and a number of spokes 94 which connect the rim 88 to the sleeve 90. The spokes 94 are secured to the sleeve at a point slightly above its bottom edge so that a small spacer 96 is formed. The bore 92 has a diameter which is slightly larger than the sleeve 58 so that the platform 34 is freely rotatable relative to the sleeve 58. The other platforms are formed in the same manner, except that their diameters are progressively larger toward the bottom of the stand. In addition, a strengthening rib 98 is secured to the bottom surface of the spokes on the lowermost platform 24. A sleeve 97 supports the platform 24 and effectively separates the platform from the base 16. It might be noted that the diameter of the platform 34 is approximately the same as, or slightly smaller than, the diameter of the guard plate 46. A similar relationship exists between the remaining platforms and guard plates, as well. Thus, a specific platform is paired with a guard plate.

A plurality of vertically oriented posts 100 are aligned along the periphery of each platform rim, and they are provided for retaining the rectangular cards 102. The length of each post is slightly shorter than the distance between a specific platform and its paired guard plate. The posts 100 are equidistantly spaced apart, so that the card 102 will fit between any two adjacent posts. Each post is provided with a pair of grooves 104 and 106 on opposite sides thereof. The width of each groove is slightly larger than the thickness of the cards 102, so that the cards will readily slide into the grooves. In addition, the top end 108 of each groove is slightly tapered or funnel-shaped to facilitate easy entry of the cards into the grooves.

While the drawings illustrate all the posts 100 as being equidistantly spaced apart, it should be realized of course, that the posts on one platform might be spaced differently than the posts on another platform. This would permit the use of different size cards if desired. In addition, if desired the overall height of the platforms (i.e., posts) might vary as well.

Figure 1:
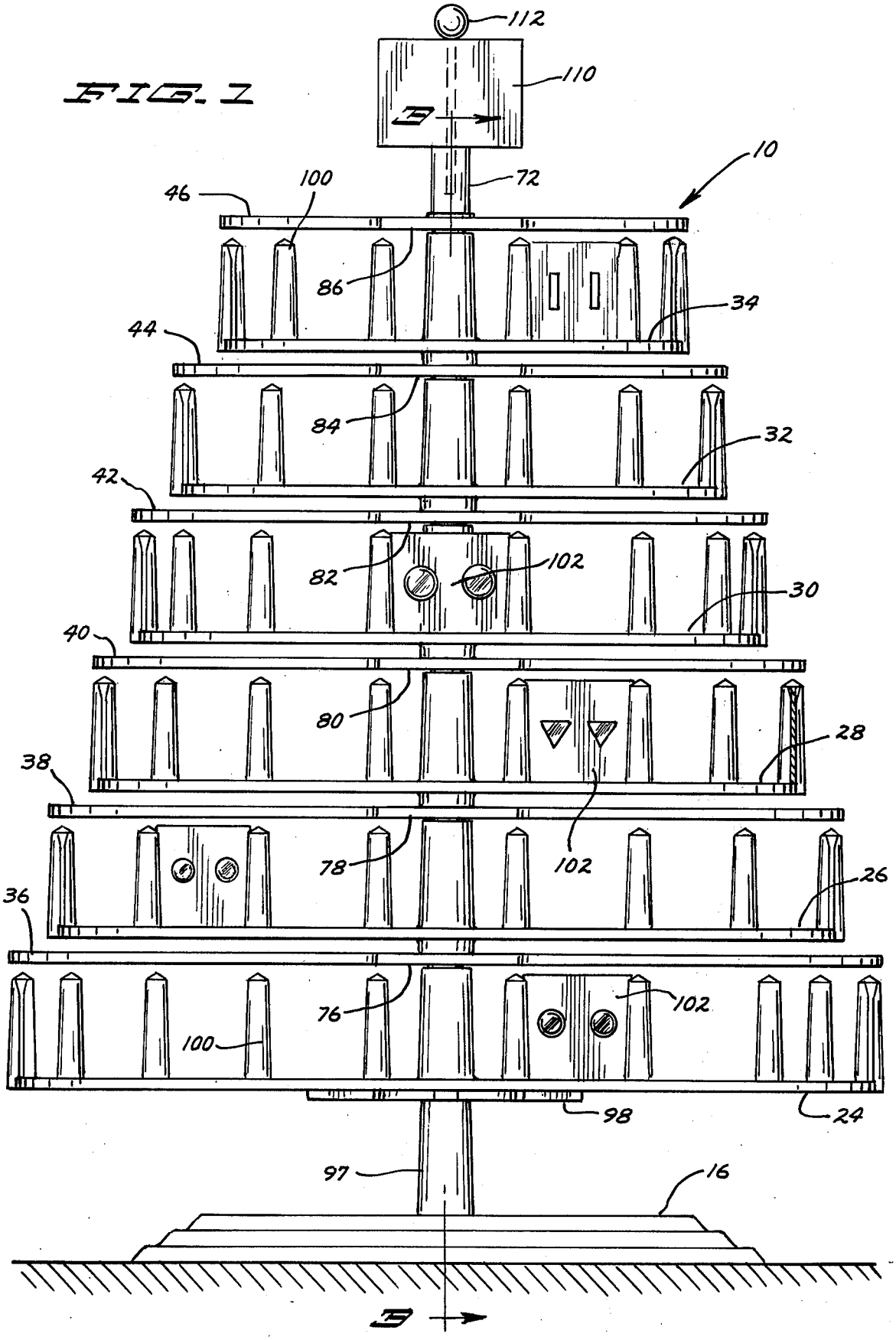
FIG. 1 is a side-elevational view of a display device constructed in accordance with the invention.

As shown in FIG. 1, a block 110 is affixed to the top end of the shaft 14 by securing a threaded bolt 112 unto the end of the shaft. The block can be used for decorative purposes, or the like.

The display stand 15 assembled by attaching the shaft 14 to the base 16 by means of the nut 22. The sleeves 48 and 98 are positioned on the shaft so that the sleeve 97 surrounds a portion of the sleeve 48, after which the platform 24 is mounted on the shaft so that it rests on the top edge of the sleeve 97 and the sleeve or hub 90 surrounds a portion of the sleeve 48. The guard plate 36 is then positioned on the shaft 14 so that it abuts against the top edge of the sleeve 48. It should be observed that the top edge of the sleeve 90, as well as the top end of the posts 100, do not contact the bottom surface of the plate 36; as a result, the platform 24 is freely rotatable relative to the shaft 14 and the sleeve 48. It should be observed further, that the platform 24 is superposed by the guard plate 36 so that the posts 100 are effectively covered.

The assembly of the display stand is completed by positioning the sleeves 50–58, the platforms 26–34, and the guard plates 38–46 on the shaft 14 so that the smallest platform 34 and guard plate 46 are positioned at the top of the stand. It can be seen that the spacer portions 96 bear upon the top surface of the guard plates and effectively separate the bottom surface of the platforms from the top surface of the guard plates.

The final step in assembling the stand involves securing the threaded member 72 to the top end 70 of the shaft. As the member 72 is threaded onto the shaft, the guard plates 36–46 and sleeves 48;14 58 are drawn together so that they are non-rotatable relative to the shaft 14. Since the platforms 24–34 are axially movable a small distance between adjacent guard plates, they remain freely rotatable with respect to the sleeves 48–58 and shaft 14. As viewed in FIG. 2, all the notches 76–86 are aligned with respect to each other, so that they are positioned along one side of the display stand.

In operation, the display stand is loaded by inserting the cards 102 until all, or at least a portion, of the spaces between the posts 100 are filled. This can only be accomplished when an open space between two adjacent posts is aligned with one of the notches in the guard plate. Each card is retained within the groove of two adjacent posts, i.e., the groove 104 on one post and the groove 106 of an adjacent post. The display stand is then positioned on a counter so that the notches are facing away from the viewer or customer. Since removal of the cards 102 is restricted only to those cards in direct alignment with the notches, it is relatively difficult for an unauthorized person to reach around the stand and remove the merchandise without being observed. Thus, the display stand has been found to effectively eliminate, or at least minimize, the unauthorized removal of merchandise from the display stand.

While it is envisioned that the display stand might be made of a variety of materials, it is preferable that all the parts, with the exception of the shaft 14 and the sleeves 48–58 be formed of a hard, clear plastic material. In addition, it has been found that the use of a gold colored metal for the sleeves 48–58 adds a colorful decorative effect. These aspects are optional however, and if desired a variety of materials and colors might be used.

In the above description and attached drawings, a disclosure of the principles of the invention is presented, together with a specific embodiment by which the invention might be carried out.

The embodiments of the invention in which an exclusive property or privilege is claimed are defined as follows:

1. A display device comprising a base member, a verticallty oriented shaft secured to said base member, a series of horizontally aligned platforms rotatably mounted on said shaft, said platforms having a circular configuration, means on said platforms for retaining a plurality of display cards, said cards being removable from said retaining means, a series of horizontally aligned guard plates, said guard plates having a circular configuration, and means for securing said plates to the shaft so that each plate is positioned above a platform in close proximity therto, said plates being non-rotatable relative to the shaft, each plate including a notch proximate its periphery for permitting said display cards to be removed from the retaining means on the platforms, said platforms and plates being axially aligned along the vertical shaft in paired relationship, the diameters of the paired platforms and plates being approximately the same, the diameter of said platforms and guard plates decreasing in length in an upward direction whereby the uppermost platform and plate has the smallest diameter and lowermost platform and plate has the greatest diameter, a plurality of sleeves mounted on said shaft, means for positioning a separate sleeve between two adjacent guard plates, means for coupling the guard plates and the sleeves together on the shaft so that the said sleeves and said guard plates are non-rotatable relative to the shaft, at least the upper end of said shaft being threaded, means for threadedly engaging said threaded shaft end and drawing said sleeves and guard plates together so that they are non-rotatable relative to each other.

2. The combination of claim 1 wherein the card retaining means comprises a plurality of vertically oriented posts aligned along the periphery of the platform, said posts being equidistantly spaced apart, each post being slightly shorter than the distance between the platform and the guard plate, and including means for engaging an edge of a display card, and each notch has a substantially rectangular configuration.

3. The combination of claim 2 in which each post is provided with a pair of grooves on opposite sides thereof, said display card being slidably retained within a groove on two adjacent posts.

4. A display device comprising a base member, a vertically oriented shaft secured to said base member, a series of horizontally aligned platforms rotatably mounted on said shaft, said platforms having a circular configuration, means on each platform proximate its periphery for retaining a plurality ofdisplay cards, said cards being removable from said retaining means, a series of horizontally aligned guard plates, said guard plates having a circular configuration, means for securing said plates to the shaft so that each plate is positioned above a platform in close proximity thereto, said plates being non-rotatable relative to the shaft, each plate including a notch proximate its periphery for permitting said display cards to be removed from the retaining means on the platforms, each card being irremovable from the retaining means unless the notch is superposed with respect to said card, said platforms and guard plates being axially aligned along the vertical shaft in paired relationship, the diameters of the paired platforms and guard plates being approximately the same, the diameter of said platforms and plates decreasing in length in an upward direction whereby the uppermost platform and plate has the smallest diameter and the lowermost platform and plate has the greatest diameter, a plurality of sleeves mounted on said shaft, means for positioning a separate sleeve between two adjacent guard plates, and means for coupling the guard plates and the sleeves together on the shaft so that the said sleeves and said guard plates are non-rotatable relative to the shaft.

5. The combination of claim 4 in which each platform includes a sleeve portion which surrounds the sleeve between two adjacent plates, the length of said sleeve portion being approximately the same as the axial space between the platform and its paired guard plate.

6. The combination of claim 4 in which said guard plates are positioned relative to each other so that all the notches are aligned with respect to each other.

7. The combination of claim 4 wherein the width of each notch is slightly larger than the width of the display card.

* * * * *